United States Patent [19]

Weisse et al.

[11] 4,178,677

[45] Dec. 18, 1979

[54] SUPERCONDUCTING MAGNET ASSEMBLY AND METHOD OF MAKING

[75] Inventors: Hanns-Jörg Weisse, Erlangen; Wilhelm Jäger, Nüremberg; Helmut Uhlmann, Erlangen, all of Fed. Rep. of Germany

[73] Assignee: Siemens Aktiengesellschaft, Berlin and Munich, Fed. Rep. of Germany

[21] Appl. No.: 880,343

[22] Filed: Feb. 23, 1978

[30] Foreign Application Priority Data

Mar. 3, 1977 [DE] Fed. Rep. of Germany ..... 2709300

[51] Int. Cl.[2] ..... H01F 7/06

[52] U.S. Cl. ..... 29/605; 118/50

[58] Field of Search ..... 336/205, DIG. 1, 96; 335/215; 29/608; 68/186 R, 189, 194, 198; 118/50; 427/104, 105, 116, 62, 63

[56] References Cited

U.S. PATENT DOCUMENTS

| | | | |
|---|---|---|---|
| 2,442,587 | 6/1948 | Coggeshall et al. | 336/205 |
| 2,524,885 | 10/1950 | Clokey | 427/116 X |
| 3,025,188 | 3/1962 | Larsh et al. | 427/104 |
| 3,869,686 | 3/1975 | Benz | 335/216 |

OTHER PUBLICATIONS

German-Gebrauchsmuter, 7533199, [Oct. 1975], cited GMA-Heft 15, vom 8.4 [1976], pp. 641, 642.

*Primary Examiner*—Morris Kaplan

*Attorney, Agent, or Firm*—Kenyon & Kenyon

[57] ABSTRACT

A method for impregnating a superconducting magnet winding in which an annular cavity, which serves as a manifold for an impregnating medium, is left free at each end face of the winding confined by a coil form so that no molds are required, and the cost for finishing operations is minimal.

10 Claims, 2 Drawing Figures

SUPERCONDUCTING MAGNET ASSEMBLY AND METHOD OF MAKING

BACKGROUND OF THE INVENTION

This invention relates to superconducting magnets in general and more particularly to a method for impregnating a superconducting magnet winding.

Magnet windings with conductors of superconductive material can be used to advantage for generating strong magnetic fields. These conductors are cooled to a temperature below the so-called critical temperature of the superconductor material used for the conductors by means of a coolant, generally by means of liquid helium. The ohmic resistance of the superconductive material then disappears almost completely. Because of the correspondingly reduced power requirement, superconductor magnets, therefore, have the advantage over conventional magnets with windings of electrically normally conducting material such as copper, that stronger magnetic fields, and thereby also higher magnetic field gradients, can be produced with them.

In order to obtain very high magnetic fields and magnetic field gradients, the effective current densities in the superconducting conductors of these magnets must be chosen correspondingly high. It may be necessary to load the superconductors to nearly the current which is critical for them. Such conductors must be specially secured against mechanical instabilities, which may, for instance, consist of conductor motion. For, if a superconducting conductor has the ability to move within the magnet winding under the action of an external force, for instance, due to Lorentz forces, it can heat up due to the friction heat connected therewith or due to the conversion of kinetic energy into heat, to such a degree that its critical temperature is exceeded and it becomes normally conducting, at least at the place of the mechanical instability.

In order to prevent such instabilities of a mechanical nature and the heating up of conductors connected therewith, the individual conductors of a superconducting magnet winding can be impregnated in a manner known per se in a vacuum with a material which is subsequently hardened and thus fixes the conductors in their position. Such a vacuum impregnation is advantageous, particularly for magnet windings of thin, very brittle or breakage prone conductors, such as the $Nb_3Sn$ or $V_3Ga$ conductors of what are known as "in-situ" annealed superconductor magnets. "In-situ" annealed superconductor magnets are first wound with conductors which consist of the individual components, i.e., elements, of the superconductive compound to be formed, which have not yet reacted with each other. The magnet windings made from these composite conductors are then subsequently subjected to a heat treatment, during which the superconductive compound is then produced only through diffusion of the two components of the composite conductor. Through this manufacturing technique, excessive elongation of brittle superconductors can be avoided in the winding of the magnet windings.

Two methods are generally used for vacuum impregnation. According to the method described in British Pat. No. 1,443,207, additional forms, also called molds, are necessary, in which the magnets are flooded with the impregnating medium. With this method, the development of impregnating medium layers of greater or smaller, i.e., uncontrolled, thickness at the end faces and the cylindrical surfaces of the magnet winding is unavoidable. In addition to a degradation of the superconducting magnet winding, thick layers of impregnating medium, which contract heavily upon cooling down, also, in particular, exert forces on individual conductors, for instance, in the case of the leads to the necessary contacts, which can lead to a break of individual filaments of or the entire conductor. Later removal of these excess layers is time consuming and, in addition, always accompanied by the possibility of damaging the conductor. In addition, changing the dimensions of the magnet is relatively expensive, since new molds must always be made.

In another method for vacuum impregnating the conductors of a superconducting magnet winding, such molds are, therefore, dispensed with. For these methods, special coil forms with a winding support, on which the superconducting magnet winding to be made is wound, are necessary. Such a coil form is described, for instance, in German Petty Pat. No. 75 33 199. It contains a hollow cylindrical coil form, which is joined at each of its end faces to a washer-like end flange. The two end flanges are provided with respective axial holes, through which the winding space proper is connected to an outer, annular manifold. Each manifold is made by a corresponding depression in a cover plate which is required in addition to the coil form and which rests in a vacuum tight manner against the end face of the respective end flange. After the conductors of the winding are applied on this coil form and this winding package is provided with an outer enclosure which is impervious to the impregnating medium, an impregnating medium can be fed via a corresponding feed line into the one manifold and can be fed from there, via the axial holes in the end flange, into the spaces between the individual conductors of the magnet winding. On the opposite side, the impregnating medium is then drained off in a similar manner via axial holes and the manifold connected thereto as well as a corresponding discharge line through a cover plate. Even in this known method, the development of a layer of impregnating medium at the flanges cannot be avoided. These excess layers must be removed later. While with the method that uses molds, magnet coils with contacts can also be impregnated, this is not possible with the known coil form for manufacturing superconducting magnets, since the required cover plates on the flanges of the coil form no longer leave space for contacts. Contact can, therefore, be established only after the impregnation is completed and the cover plates are removed. This, however, eliminates the use of the known coil form, for instance, for "in-situ" annealed $Nb_3Sn$ or $V_3Ga$ magnet windings, since in these windings, the contact leads must, in general, be already preformed and installed prior to a diffusion anneal because of the relatively small bending radii, and can practically not be changed later due to the sensitivity to bending of these conductor materials. In addition, the expense for changing the dimensions of the magnet windings is also relatively high with this method, as new cover plates are necessary.

SUMMARY OF THE INVENTION

It is, therefore, an object of the present invention to provide a method for impregnating a superconducting magnet winding, in which these difficulties in the known manufacturing methods do not occur or only to an insignificant degree. In particular, this method should also be suitable for impregnating magnet windings of thin, brittle and breakage prone conductors, such as, for instance, $Nb_3Sn$ or $V_3Ga$ conductors of "in-situ" annealed superconductor magnets which, in addition, can be completely contacted and may have different sizes, without the need for expensive aids, such as molds or sealed cover plates. In addition, thick impregnating medium layers at the surfaces of the magnet winding are to be avoided so that only relatively little rework of the impregnated magnet winding is necessary.

This problem is solved in a method of the kind mentioned at the outset by the provision that an annular cavity which serves, at least partially, as a manifold, is left free at each end face in the winding space confined by the coil form.

This embodiment of the method has the particular advantage that the production cost for impregnating the magnet winding is relatively low. Thus, the construction of the manifolds, which can be adapted to the particular winding dimensions, requires no additional operations for a prefabricated coil form. The difficulties which thick impregnating medium layers, which occur with the known methods, are eliminated, since the impregnating medium can essentially fill only the cavities which are present in the space which is defined by the coil form and the outer circumference of the magnet winding. Since no additional devices such as cover plates on the upper sides of the flanges are necessary, completely contacted magnet windings, particularly "in-situ" annealed $Nb_3Sn$ magnet windings can also be impregnated. The finishing operations for the impregnated magnet winding are limited substantially to the removal of the required feed and discharge lines for the impregnating medium.

Apparatus for carrying out the method according to the present invention, which contains axial canals, via which the impregnating medium is fed from the manifolds into the magnet winding and is drained again therefrom, is characterized by the feature that on each end face, between the magnet winding and the associated end flange of the coil form, an annular cavity is developed, in which a disc provided with axial canals is arranged parallel to the respective end flange, and that the manifold is a subspace of the cavity developed between the disc and the end flange.

Perforated metal sheets can advantageously be provided as discs with axial canals. Suitable perforated sheet metal of various nonmagnetic materials, such as stainless steel, are commercially available and can easily be made into the required discs.

DETAILED DESCRIPTION OF THE INVENTION

Figure 1:
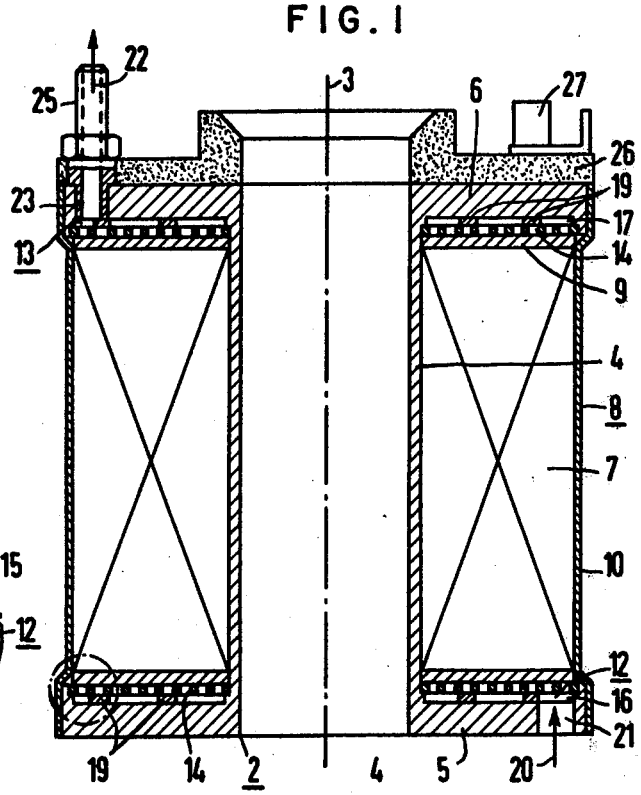
FIG. 1 of the drawing is a schematic cross section through apparatus for implementing the method according to the present invention.
Figure 2:
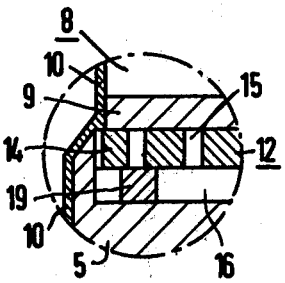
FIG. 2 is an enlarged section of FIG. 1.

The device of the present invention consists of a shaped body which contains a coil form 2 with a hollow cylindrical central part 4 which has rotational symmetry with respect to an axis 3. The tubular center part is connected at its end faces to washer-like end flanges 5 and 6. The central part 4 and the end flanges 5 and 6 can be formed as a single unit. Onto the coil form 2 formed by the parts 4 to 6 is placed a winding package 7 of a magnet winding 8. This may be, for instance, a winding package of "in-situ" annealed $Nb_3Sn$ conductors. The winding package 7 is terminated at both its end faces by a layer 9. This layer, which serves primarily for insulating the winding from adjacent metallic parts, consists, for instance, of individual strips of textile or glass fabric and is transparent to an impregnating medium. Optionally, the layer 9 can be omitted. The winding package 7 is furthermore tightly enclosed at its outer circumference by a coil enclosure, for instance, a wrapping 10. As indicated in the figure, the wrapping 10 can cover not only the winding package 7, but also the end flanges 5 and 6.

Between the magnet winding 8, which consists of the winding package 7, the layer 9 and the wrapping 10, and the end flanges 5 and 6, there are respective flat, washer-like, i.e., annular, cavities 12 and 13, the size of which is fixed by the given dimensions of the magnet winding 8 and the coil form 2. In each of these cavities a disc 14 with axial holes 15 is arranged in a radial plane. The disc 14 may be, for example, a perforated metal plate. This perforated metal plate advantageously consists of nonmagnetic material, such as stainless steel or plastic. Since its axial thickness is less than the axial dimension of the cavities 12 and 13, respectively, and the perforated plates each rest with one side against the layers 9 confining the winding package 7, a flat, washer-like, i.e., annular, manifold is generated between each of them and the end flanges 5 and 6. The manifold associated with the lower end flange 5 of the coil form 2 is designated in the figure as 16 and the manifold associated with the upper end flange 6, as 17.

The perforated sheets 14 can advantageously be provided with support nipples 19 on their sides facing the manifolds 16 and 17. The nipples 19 rest against the end flanges 5 and 6 to support the sheets thereon. Thus, movement of the perforated plates 14 in the manifolds 16 and 17 and, in particular, deformation of the generally relatively thin sheets by the winding pressure of the winding package 7 can be prevented.

As soon as the magnet winding to be impregnated is sealed vacuum tight in a manner known per se, for instance, by wrapping, and is tested for leaks, it can now be impregnated in a vacuum with a liquid impregnating medium, for instance, a hardenable synthetic resin. To this end, the impregnating medium is first fed into the lower manifold 16 via a hole 21 in the lower end flange 5, as indicated in the figure by an arrow 20. It then flows through the axial holes 15 of the adjacent perforated plate 14 and between the strips of the layer 9 into the voids between the conductors of the winding package 7. In a similar manner, the impregnating medium passes into the upper part of the winding package 7, and flows via the gaps developed between the strips of the layers 9 and via the axial holes 15 of the upper perforated plate 14 into the upper manifold 17. From manifold 17 it is drained off to the outside via a discharge hole 23 in the upper end flange 6, as indicated by an arrow 23.

Contrary to the known formed bodies for manufacturing superconducting magnet windings, the impregnating medium is fed in, with the formed body for implementing the method according to the present invention, not via special additional devices such as cover plates, but directly via feeding and discharge systems directly integrated into the coil flanges.

For feeding in and discharging the impregnating medium, nozzles for the necessary feed and discharge lines are connected to or, for instance, screwed into the holes 21 and 23 in the end flanges 5 and 6. In the figure, only the outlet nozzle 25 of the discharge line for the impregnating medium is indicated. After the voids in the magnet winding are filled with the impregnating medium, and after the impregnating medium has set, it is only necessary to remove these feed and discharge lines for the impregnating medium. Further rework of the magnet winding is not necessary.

In the figure, a contact plate 26, which is arranged on the upper end flange 6 and to which contact elements for making a connection between the conductors of the magnet winding 8 and the necessary current supply leads can be fastened, is shown. In the figure, one contact element 27 on the contact plate 26 is shown in detail.

What is claimed is:

1. A method of forming an impregnated superconducting magnet winding comprising:

(a) disposing a superconducting magnet winding on a coil form having a hollow cylindrical central part and washer-like end flanges, so as to leave a free space at each end between the winding and a respective end flange;

(b) disposing a disk containing a plurality of axial canals in each of said free spaces such as to form a subspace between each of said disks and a respective end flange;

(c) sealing the winding and spaces at the outer periphery thereof so as to form annular cavities at each of said subspaces between said disks and said end flanges thereby forming a manifold interior of each of said end flanges;

(d) forming an opening into each of said manifolds;

(e) feeding an impregnating medium through one of said openings to one of said manifolds whereby the medium will flow through said canals in the one disk, through said winding and the canals in said other disk to the other manifold; and (f) removing excess impregnating medium through the other opening.

2. A superconducting magnet winding structure which is adapted to be impregnated without external fixtures comprising:

(a) a coil form having a hollow cylindrical central part and washer-like end flanges;

(b) a superconducting magnet winding disposed of said coil form with a space between said winding and each of said end flanges;

(c) a disk containing a plurality of axial canals disposed in each of said spaces spaced from a respective end flange so as to form a subspace between said disk and said end flange;

(d) means sealing around said magnet winding and spaces at each end thereof thereby forming a manifold at each of said subspaces; and (e) an opening from outside said structure to each of said manifolds, whereby an impregnating medium can be fed into one of said openings to one manifold, through one of said disks, said magnet winding and the other disk to the other manifold and excess medium removed through the other opening.

3. A superconducting magnet winding structure according to claim 2, wherein each said disc comprises a perforated plate.

4. A superconducting magnet winding structure according to claim 3, and further including support nipples on said discs resting against the respective end flanges.

5. A superconducting magnet winding structure according to claim 3, wherein said magnet winding includes a winding package terminated at its end faces by a layer which is pervious to the impregnating medium.

6. A superconducting magnet winding structure according to claim 5, wherein said discs rest directly against said layers.

7. A superconducting magnet winding structure according to claim 2, and further including support nipples on said discs resting against the respective end flanges.

8. A superconducting magnet winding structure according to claim 7, wherein said magnet winding includes a winding package terminated at its end faces by a layer which is pervious to the impregnating medium.

9. A superconducting magnet winding structure according to claim 8, wherein said discs rest directly against said layers.

10. A superconducting magnet winding structure according to claim 2, wherein said magnet winding includes a winding package terminated at its end faces by a layer which is pervious to the impregnating medium.

* * * * *